US006823780B2

(12) United States Patent
Vogt et al.

(10) Patent No.: US 6,823,780 B2
(45) Date of Patent: Nov. 30, 2004

(54) LABELING SYSTEM FOR A CANDLEWICK

(75) Inventors: Gil Vogt, Erlanger, KY (US); Steven T. Jones, Independence, KY (US)

(73) Assignee: Atkins & Pearce, Inc., Covington, KY (US)

( * ) Notice: Subject to any disclaimer, the term of this patent is extended or adjusted under 35 U.S.C. 154(b) by 0 days.

(21) Appl. No.: 10/403,749

(22) Filed: Mar. 31, 2003

(65) Prior Publication Data

US 2003/0183098 A1 Oct. 2, 2003

Related U.S. Application Data

(60) Provisional application No. 60/369,005, filed on Apr. 1, 2002.

(51) Int. Cl.[7] ..... B41F 17/00
(52) U.S. Cl. ..... 101/35; 101/288
(58) Field of Search ..... 101/35, 36, 37, 101/288, 483; 226/148, 156; 400/208, 613

(56) References Cited

U.S. PATENT DOCUMENTS 544,466 A * 8/1895 Smyczek et al. ..... 248/177.1
2,920,384 A * 1/1960 Fasoli et al. ..... 29/407.05
3,335,583 A * 8/1967 Schutte ..... 68/203
3,491,561 A * 1/1970 Crump ..... 68/202
3,907,487 A * 9/1975 Reiher ..... 425/517
3,994,250 A * 11/1976 Norris ..... 112/475.08
4,705,415 A * 11/1987 Grombchevsky et al. ..... 400/202.4
5,237,917 A * 8/1993 Traut et al. ..... 101/35
5,289,767 A * 3/1994 Montalto et al. ..... 101/35
5,671,667 A * 9/1997 Simmet ..... 101/35
5,709,486 A * 1/1998 Day ..... 400/208
6,673,503 B2 * 1/2004 Wagner et al. ..... 430/124

* cited by examiner

*Primary Examiner*—Ren Yan
(74) *Attorney, Agent, or Firm*—Wood, Herron & Evans, LLP

(57) ABSTRACT

A method and apparatus for printing indicia onto a candlewick to provide identification of the wick following its removal from a supply spool. The candlewick is coated prior to the printing process and a printer is used to print the indicia onto the coated wick. A registration mechanism is provided to align the coated wick relative to the printer during the printing process.

15 Claims, 2 Drawing Sheets

LABELING SYSTEM FOR A CANDLEWICK

The present application claims the filing benefit of U.S. Provisional Application Ser. No. 60/369,005, filed Apr. 1, 2002, the disclosure of which is hereby incorporated herein by reference in its entirety.

FIELD OF THE INVENTION

The present invention relates generally to candlewicks and, more particularly, to identification of a candlewick following its removal from a spool.

BACKGROUND OF THE INVENTION

The need for candlewick identification, once it has left the manufacturer, has been a constant source of concern for candle makers. Despite the candlewick being less than 1% of the cost of a finished candle, putting the wrong candlewick into a candle during production translates into thousands of dollars in lost revenue by manufacturing defective, and possibly unsafe, products. This loss not only includes the candlewick, but also other items such as wax, scents, dyes, labor and most importantly lost production time.

The labeling of candlewick has historically involved affixing identification stickers or labels to both the inside and outside of a supply spool prior to filling the spool with candlewick. This method of labeling the supply spools provides adequate identification of the candlewick until the point that it is removed from the spool for production, handling or other forms of processing such as chemical treating, dying, bleaching, waxing, cutting and tabbing. Once the wick is separated from the identified spool, it may be easily misidentified by even the most trained of eyes. Unless strict safeguards are placed into effect and followed preventing the incorrect re-labeling of the candlewick, there is a significant risk for mis-identification of the wick.

Once the candlewick has been, or is suspected of being mis-identified, the only sure way to adequately and properly "re-identify" the candlewick is to return samples of the candlewick to lab technicians who must reverse engineer the sample into its core composition and construction. Once analyzed by the technicians, the candlewick is then matched against the production methods and compositions of the candlewick manufacturer's known products until an exact match is found to properly identify the candlewick.

Accordingly, there is a need for improving the identification of candlewick following its removal from a spool to insure that the proper candlewick is selected during candle production.

SUMMARY OF THE INVENTION

The present invention overcomes the foregoing and other shortcomings and drawbacks of known methods for identifying candlewick. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, a method and apparatus are provided for printing indicia onto a candlewick which may include information that identifies the wick and/or provides any other desired information or graphics on the wick which may assist the candle maker in identifying the wick during the candle making process. In this way, candle manufacturers can, with certainly, identify the candlewick following its removal from a supply spool to be assured that the proper wick is selected for a particular candle production.

Due to the extremely small size of candlewick (typically having a diameter in a range from between about 1.0 mm to about 2.4 mm), the irregular shapes of various candlewick (flat, round, oblong, triangular, square, etc), the texture of the candlewick caused by twisting, plaiting, weaving, braiding or other processing of the candlewick fibers to make the wick, and the porous nature of candlewick fibers, printing information directly onto the candlewick fibers themselves is not feasible. To overcome the porous nature of candlewick which would tend to "bleed" any indicia applied directly to the candlewick fibers, as well as the numerous irregular shapes and textures of candlewick surfaces, the present invention includes applying an outer coating to the fibers of the candlewick prior to the printing process.

In one embodiment of the present invention, a printer, such as an ink jet print head, is used to print the indicia onto the coated candlewick at selected intervals as the candlewick moves relative to the printer from a supply spool at one end of the wick to a take-up spool at an opposite end of the wick. A registration mechanism is provided to align the candlewick relative to the printer during the printing process to center the wick horizontally (i.e., in the cross-machine direction) beneath the printer. A printer control is operatively coupled to the printer and has a user input and display that permits a user to enter and/or select the indicia to be printed onto the candlewick and displays printing information for the user.

The present invention provides a significant benefit to candle manufacturers of all types of candles by providing printed information on the candlewick that identifies the wick and/or any other desired information or graphics on the wick which may assist the candle maker in identifying the wick during the candle making process.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
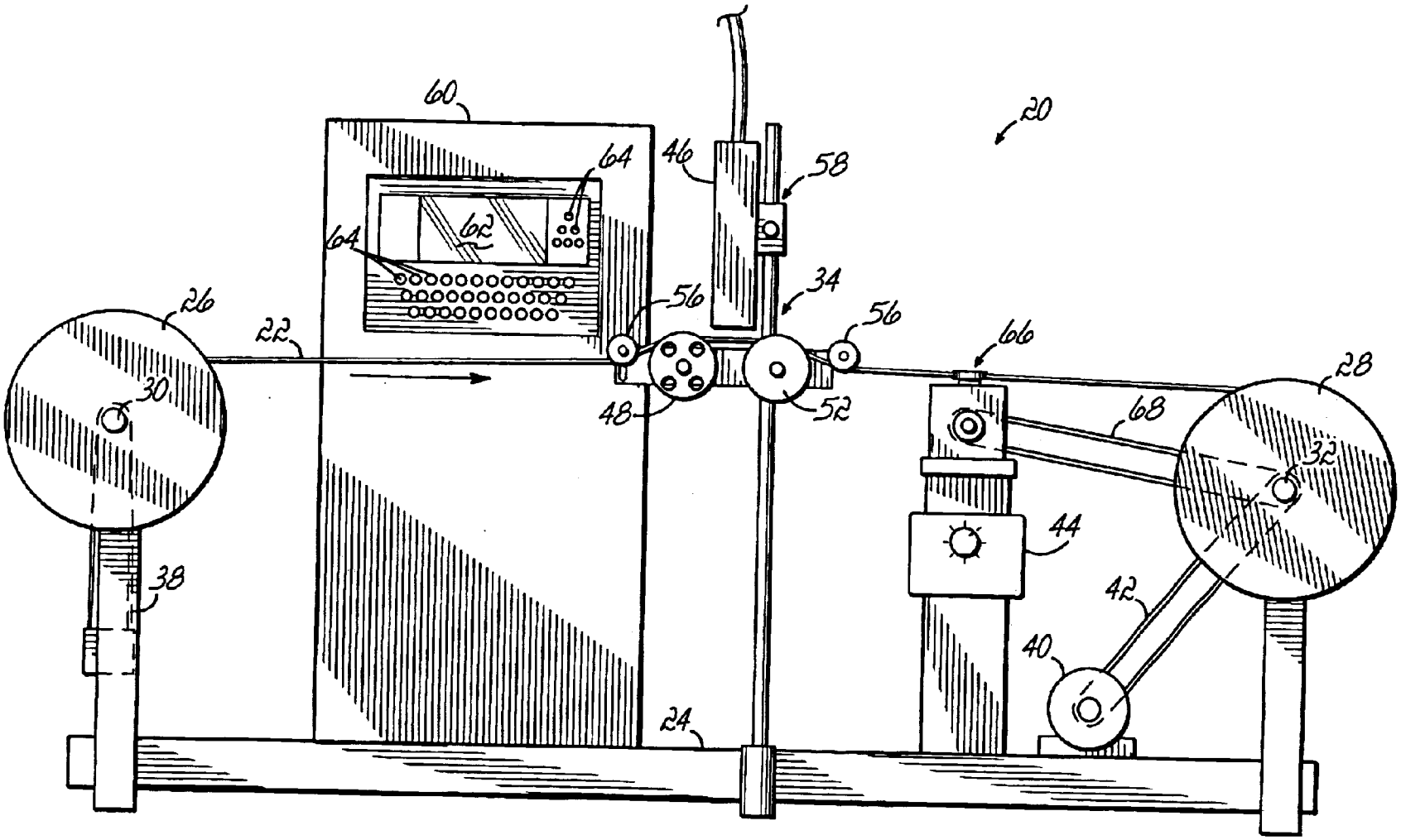
FIG. 1 is a side elevational view of a candlewick labeling system in accordance with the principles of the present invention.

Referring now to the Figures, and to FIG. 1 in particular, a candlewick labeling system 20 for printing indicia onto a coated candlewick 22 is shown in accordance with one embodiment of the present invention. The labeling system 20 includes a frame 24 which supports a supply spool 26 of coated candlewick at one end of the machine 20 and a wick take-up spool 28 at an opposite end of the machine 20. Of course, other orientations of the supply and take-up spools 26 and 28, respectively, and other supply and take-up mechanisms are possible as well without departing from the spirit and scope of the present invention. The supply spool 26 is keyed to rotate with its associated support shaft 30 which is cantilevered by the frame 24 in a conventional support bearing (not shown). Similarly, the take-up spool 28 is keyed to rotate with its associated support shaft 32 which is also cantilevered by the frame 24 in a conventional support bearing (not shown).

Figure 4:
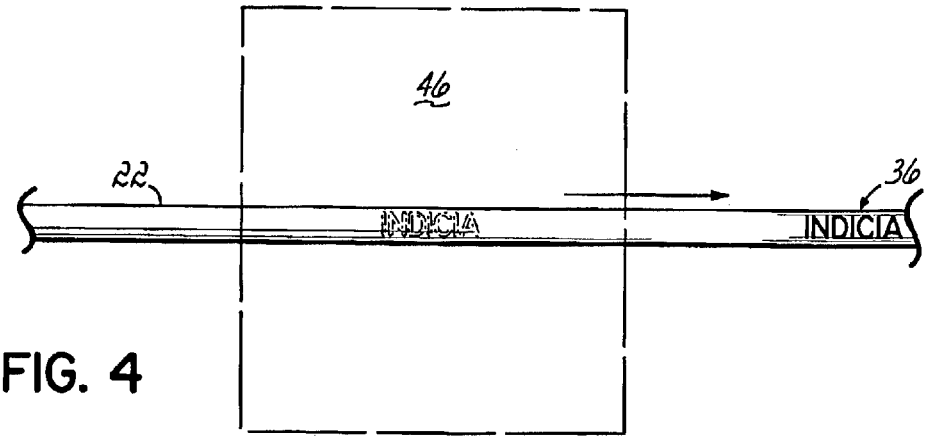
FIG. 4 is a top elevational view of a printed candlewick in accordance with the principles of the present invention.

During the wick printing process, as will be described in greater detail below, the coated candlewick 22 travels from the supply spool 26, through a wick alignment and printing station 34 where indicia 36 is printed onto the wick 22 (FIG. 4) using a printer 46, and then the printed wick is wound on the take-up spool 28. The supply spool 26 and its associated shaft 30 are non-driven, and the free rotation of the supply spool 26 is governed by a weight-tensioned strap 38 that is supported about the shaft 30. A variable speed drive mechanism or motor 40 is operatively coupled through a belt 42 to the shaft 32 that supports the take-up spool 28. The rotational speed of the driven take-up spool 28 is controlled through a user-operated motor control 44 that permits a user to select the desired rotational speed of the driven take-up spool 28 during the wick printing process.

To overcome the porous nature of candlewick which would tend to "bleed" any indicia applied directly to the candlewick fibers, as well as the numerous irregular shapes and textures of candlewick surfaces, the present invention includes applying an outer coating, such as a conventional petroleum product or wax for example, to the fibers of a candlewick prior to the printing process. In one embodiment, the outer coating is smoothed by passing the coated candlewick through a metered and heated die (not shown) as is well known to those of ordinary skill in the art. It will be appreciated that other outer coatings for the candlewick 22, and other methods for applying the outer coating to the wick, are possible as well without departing from the spirit and scope of the present invention. Preferably, the outer coating of candlewick 22 is substantially non-porous to prevent "bleeding" of the printed indicia 36 following the printing process, and is also a combustible material so that the candlewick 22 is non-toxic when burned.

Figure 2:
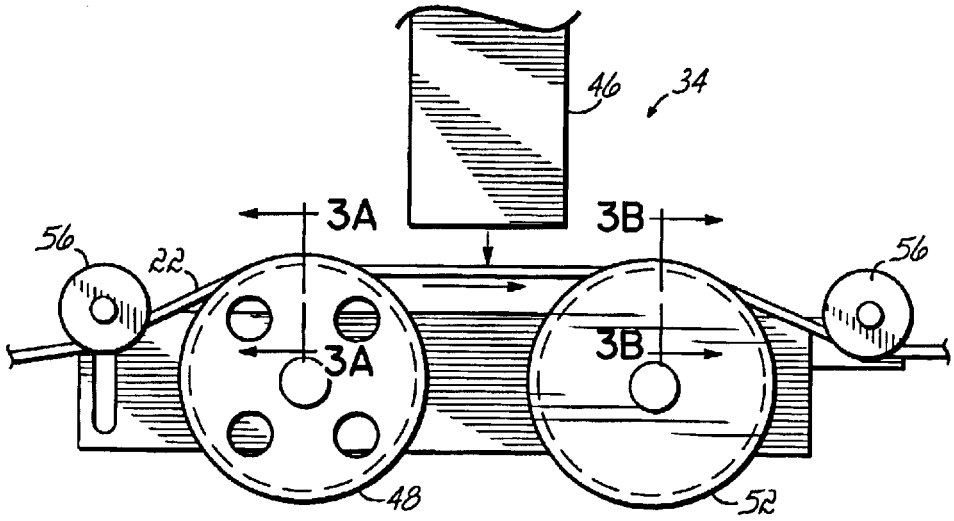
FIG. 2 is an enlarged view of a wick alignment and printing station of the candlewick labeling system of FIG. 1.
Figure 3A:
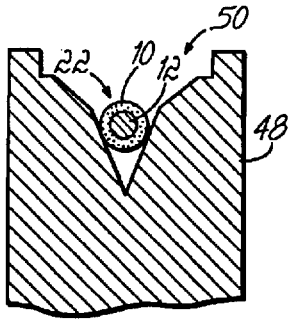
FIG. 3A is a cross-sectional view taken along line 3A—3A of FIG. 3.
Figure 3B:
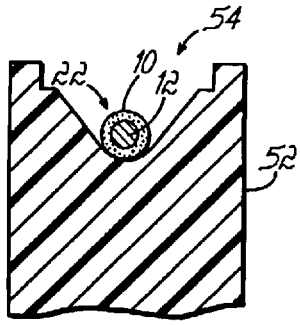
FIG. 3B is a cross-sectional view taken along line 3B—3B of FIG. 3.

At the wick alignment and printing station 34, precision alignment of the printer 46 in relation to the candlewick 22 is critical when printing onto a surface that may have a radius as small as 0.019" for example. It is desirable to have a precision alignment guide equal to the diameter of the coated candlewick 22 both before and after the printer 46 to center the wick 22 horizontally (i.e., in the cross-machine direction) beneath the printer 46. Of course, other orientations of the printer 46 relative to the wick 22 are possible as well without departing from the spirit and scope of the present invention. To eliminate the need for manually changing the wick guide positions when printing on wicks of various diameters, a deep-walled rotatable member or pulley 48 having a generally "V"-shaped groove 50 formed circumferentially thereabout is used as the alignment guide before the printer 46 as shown in FIGS. 2 and 3A. The "V"-shaped groove 50 (see FIG. 3A) of the pulley 48 allows any size or shape candlewick to automatically find its own center when placed into the pulley 48. A second alignment pulley or rotatable member 52 having a generally "V"-shaped groove 54 (see FIG. 3B) formed circumferentially thereabout is provided after the printer 46 to precisely guide the wick 22 beneath the printer 46 in cooperation with the alignment pulley 48. To overcome undesirable vertical movement with the candlewick 22 during printing, tension wheels 56 are provided both before and after the pair of alignment pulleys 48 and 52. The tension wheels 56 provide a consistent tension on the candlewick 22 to eliminate vertical "waving" of the wick 22 beneath the printer 46 which may produce irregular and blurred print.

In one embodiment of the present invention, the printer 46 is an ink jet print head, and may comprise a Domino Model A200 Pinpoint ink jet print head commercially available from Domino of Gurnee, Ill., although other suitable printers and print heads are possible as well for use in the present invention. The printer 46 is mounted on an adjustable platform 58 that permits user adjustment of the printer position relative to the coated candlewick 22 in both the horizontal (cross-machine) and vertical directions. The printer 46 may be spaced within ½ inch of the candlewick 22 and apply conventional wax-based ink or solvent-based ink to print the indicia 36 (FIG. 4) onto the coated wick 22. In one embodiment, the printer 46 is controlled by a printer control 60 which is operatively coupled to the printer 46. The printer control 60 has a display 62 and a user input 64 that permits a user to enter and/or select the indicia 36 to be printed onto the candlewick 22 and displays printing information for the user. It will be appreciated by those of ordinary skill in the art that other printer controls are possible as well without departing from the spirit and scope of the present invention An encoder (not shown) is incorporated into the printing process to sense the speed at which the candlewick 22 is passing beneath the printer 46. The encoder (not shown) is operatively connected to the alignment pulley 48 in a conventional manner and is electrically coupled to the printer control 60 so that the encoder (not shown) applies electrical pulses to the printer control 60 as the pulley 48 rotates in response to movement of the candlewick 22. The printer control 60 counts the pulses and instructs the printer 46 when and how fast to fire its ink jets so that the printer 46 prints legibly and consistently onto the coated wick 22 at pre-programmed intervals regardless of the speed at which the candlewick 22 is moving. The interval distance between the indicia labels 36 is programmable by the user through the printer control 60. When no movement of the candlewick 22 is detected, the printer control 60 will stop the printer 46 from printing.

A conventional traverse 66 is supported by the frame 24 downstream of the wick alignment and print station 34. The traverse 66 is operatively coupled through a belt 68 to the shaft 32 that supports the take-up spool 28. In this way, the rotational speed of the shaft 32 controls the speed of the traverse 66 so that the printed candlewick 22 is uniformly layered about the take-up spool 28 as will be appreciated by those of ordinary skill in the art.

It will be appreciated that the present invention provides a significant benefit to candle manufacturers of all types of candles by providing printed information on the candlewick that identifies the wick and/or provides any other desired information or graphics on the wick which may assist the candle maker in identifying the wick during the candle making process. In this way, the printed candlewick is readily identifiable following its removal from a spool to insure that the proper candlewick is selected by the candle manufacturer during production.

While the present invention has been illustrated by a description of various embodiments and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of Applicant's general inventive concept.

Having described the invention,

We claim:

1. An apparatus for printing indicia onto a candlewick having an outer coating applied thereto, comprising:

a printer operable to print indicia onto the outer coating of the candlewick;

a first alignment guide positioned upstream of said printer and having a circumferential groove formed therein, said first alignment guide being rotatable about a first axis;

a second alignment guide positioned downstream of said printer and having a circumferential groove formed therein, said second alignment guide being rotatable about a second axis parallel to the first axis, said circumferential grooves of said first and second alignment guides contacting the candlewick at spaced apart locations during movement of the candlewick relative to the printer to align the candlewick in a first direction relative to said printer;

a first tension member positioned upstream of said first alignment guide; and a second tension member positioned downstream of said second alignment guide, said first and second tension members contacting the candlewick at spaced apart locations during movement of the candlewick relative to the printer so as to provide tension to the candlewick between the first and second alignment guides to align the candlewick in a second direction relative to said printer during a printing operation.

2. The apparatus of claim 1 wherein said printer comprises an ink jet print head.

3. The apparatus of claim 1 further comprising a printer control operatively coupled to said printer and having a user input operable to permit a user to define the indicia to be printed on the candlewick and a user display operable to display indicia information to the user.

4. An apparatus for printing indicia onto a candlewick having an outer coating applied thereto, the candlewick extending between a supply spool at one end thereof and a take-up spool at on opposite and thereof, comprising:

a first shaft member operable to support the supply spool;

a second shaft member operable to support the take-up spool with the candlewick extending therebetween;

a printer operable to print indicia onto the outer coating of the candlewick during movement of the candlewick relative to the printer from the supply spool to the take-up spool;

a first alignment guide positioned upstream of said printer and having a circumferential groove formed therein, said first alignment guide being rotatable about a first axis;

a second alignment guide positioned downstream of said printer and having a circumferential groove formed therein, said second alignment guide being rotatable about a second axis parallel to the first axis, said circumferential grooves of said first and second alignment guides contacting the candlewick at spaced apart locations during movement of the candlewick relative to the printer to align the candlewick in a first direction relative to said printer;

a first tension member positioned upstream of said first alignment guide; and a second tension member positioned downstream of said second alignment guide, said first and second tension members contacting the candlewick at spaced apart locations during movement of the candlewick relative to the printer so as to provide tension to the candlewick between the first and second alignment guides to align the candlewick in a second direction relative to said printer during a printing operation.

5. The apparatus of claim 4 wherein sold printer comprises an ink jet print head.

6. The apparatus of claim 4 further comprising a printer control operatively coupled to said printer and having a user input operable to permit a user to define the indicia to be printed on the candlewick and a user display operable to display indicia information to the user.

7. The apparatus of claim 4 further comprising a drive mechanism operable to rotate said second shaft member to thereby rotate the take-up spool.

8. A method of printing indicia onto a candlewick using a printer, comprising:

applying an outer coating to essentially the entire surface of the candlewick; and printing indicia onto the outer coating of the candlewick using the printer.

9. The method of claim 8 wherein the outer coating is substantially non-porous.

10. The method of claim 8 wherein the outer coating is combustible.

11. A method of printing indicia onto a candlewick using a printer, comprising:

applying an outer coating to essentially the entire surface of the candlewick;

registering the candlewick relative to the printer; and printing indicia onto the outer coating of the candlewick using the printer.

12. The method of claim 11 wherein the registering step comprises:

supporting the candlewick at spaced apart locations.

13. The method of claim 11 further comprising:

moving the candlewick relative to the printer.

14. The method of claim 11 further comprising:

extending the candlewick between a supply spool at one end thereof and a take-up spool at an opposite end thereof.

15. The method of claim 14 further comprising:

moving the candlewick relative to the printer from the supply spool to the take-up spool.

* * * * *

UNITED STATES PATENT AND TRADEMARK OFFICE

CERTIFICATE OF CORRECTION

PATENT NO. : 6,823,780 B2
DATED : November 30, 2004
INVENTOR(S) : Gil Vogt et al.

It is certified that error appears in the above-identified patent and that said Letters Patent is hereby corrected as shown below:

Column 4,
Line 28, change “of the present invention” to -- of the present invention. --.

Column 5,
Line 1, change “intention of the Applicant to restrict” to -- intention of the Applicants to restrict --.
Line 9, change “of Applicant’s general inventive concept.” to -- of Applicant’s general inventive concept. --.
Line 49, change “at on opposite and thereof, comprising:” to -- at an opposite end thereof, comprising: --.

Column 6,
Line 20, change “wherein sold printer comprises” to -- wherein said printer comprises --.

Signed and Sealed this

Twenty-fourth Day of May, 2005

JON W. DUDAS
*Director of the United States Patent and Trademark Office*